US006732881B1

(12) United States Patent
Gulati

(10) Patent No.: US 6,732,881 B1
(45) Date of Patent: May 11, 2004

(54) LIQUEFIED GAS STORAGE TANK

(75) Inventor: Kailash C. Gulati, Plano, TX (US)

(73) Assignee: Mobil Oil Corporation, Fairfax, VA (US)

( * ) Notice: Subject to any disclaimer, the term of this patent is extended or adjusted under 35 U.S.C. 154(b) by 361 days.

(21) Appl. No.: 09/256,383

(22) Filed: Feb. 24, 1999

Related U.S. Application Data

(60) Provisional application No. 60/104,325, filed on Oct. 15, 1998.

(51) Int. Cl.[7] ..... B65D 6/34

(52) U.S. Cl. ..... 220/560.04; 220/653

(58) Field of Search ..... 220/560.07, 560.08, 220/564, 651, 653, 654, 4.12, 668, 565, 567.2, 560.04; 52/651.1, 653.1, 167.3; 114/83

(56) References Cited

U.S. PATENT DOCUMENTS

| | | | | | |
|---|---|---|---|---|---|
| 1,477,686 | A | * | 12/1923 | Braender | 220/900 X |
| 1,631,051 | A | * | 5/1927 | Nichols | 220/4.12 |
| 1,864,759 | A | * | 6/1932 | Pritchard | 220/565 |
| 1,933,860 | A | * | 11/1933 | Kjekstad | 114/79 R |
| 2,082,836 | A | | 6/1937 | Kjekstad | |
| 2,083,051 | A | * | 6/1937 | Chapas | 244/125 |
| 2,156,400 | A | | 5/1939 | Pechstein | |
| 2,296,414 | A | * | 9/1942 | Albrecht | 220/653 |
| 2,331,483 | A | * | 10/1943 | Lawman et al. | 220/565 |
| 2,333,792 | A | | 11/1943 | Jackson | |
| 2,337,049 | A | * | 12/1943 | Jackson | 220/679 |
| 2,341,547 | A | * | 2/1944 | Heineman | 220/565 |
| 2,380,089 | A | * | 7/1945 | Ulm | 220/565 |
| 2,382,357 | A | * | 8/1945 | Watter | 52/222 |
| 2,386,019 | A | * | 10/1945 | Watter | 52/84 |
| 2,412,578 | A | * | 12/1946 | Harris | 114/83 |
| 2,533,041 | A | * | 12/1950 | Plummer | 220/652 |
| 2,673,001 | A | * | 3/1954 | Ulm et al. | 220/565 |
| 2,911,125 | A | * | 11/1959 | Dosker | 220/560.5 |
| 2,975,927 | A | * | 3/1961 | Arne | 220/565 |
| 2,982,441 | A | | 5/1961 | Farrell et al. | |
| 3,062,402 | A | * | 11/1962 | Farrell et al. | 220/653 |
| 3,172,560 | A | * | 3/1965 | Bergmann | 220/564 |
| 3,441,164 | A | | 4/1969 | Wang | |
| 3,472,414 | A | | 10/1969 | Rodrigues | |
| 3,602,391 | A | * | 8/1971 | Tramontini | 220/653 |
| 3,731,450 | A | * | 5/1973 | Chateau | 52/653.1 |
| 3,799,383 | A | | 3/1974 | Gerhard | |
| 3,931,908 | A | * | 1/1976 | Cheyney | 220/560.15 |
| 5,143,283 | A | * | 9/1992 | Lancaster | 220/651 |
| 5,375,547 | A | | 12/1994 | Abe et al. | |
| 5,505,035 | A | * | 4/1996 | Lalvani | 52/648.1 |
| 5,651,474 | A | * | 7/1997 | Callaghan et al. | 220/565 |
| 6,076,324 | A | * | 6/2000 | Daily et al. | 52/648.1 |

* cited by examiner

*Primary Examiner*—Nathan J. Newhouse
*Assistant Examiner*—Joseph C Merek
(74) *Attorney, Agent, or Firm*—Drude Faulconer

(57) ABSTRACT

A large, box-like polygonal tank for storing liquefied gas on land or on ground based structures (GBS) and a method of constructing the tank. The tank is comprised of an internal, truss-braced, rigid frame, having a cover on the frame for containing the stored liquid within the tank. The internal, truss-braced frame allows the interior of the tank to be contiguous throughout while compensating for the dynamic loads caused by the "sloshing" of stored liquid which, in turn, is due to the short excitation periods cause by seismic activity or the like.

10 Claims, 3 Drawing Sheets

LIQUEFIED GAS STORAGE TANK

CROSS-REFERENCE TO EARLIER APPLICATION

The present application claims the priority of U.S. Provisional Application No. 60/104,325, filed Oct. 15, 1998 by the present inventor.

DESCRIPTION

1. Technical Field

The present invention relates to liquefied gas storage tanks and in one aspect relates to a tank especially adapted for storing cryogenic liquefied gases (e.g., liquefied natural gas ("LNG")) at cryogenic temperatures at near atmospheric pressures in areas susceptible to earthquake activity.

2. Background

Liquefied natural gas (LNG) is typically stored in double walled tanks or containers. The inner tank provides the primary containment for the LNG while the outer shell holds the insulation in place and protects the inner tank and the insulation from the adverse effects of the environment. Sometimes, the outer tank is also designed to provide a secondary containment of LNG and associated gas vapor in case the inner tank fails. Typical sizes of onshore tanks at import or export terminals range from 50,000 to 100,000 cubic meters although tanks as large as 200,000 cubic meters have been built or are under construction.

Two distinct types of tank construction are widely used for storing LNG at onshore locations. The first of these comprise a flat-bottomed, cylindrical, self-standing tank which typically uses a 9% nickel steel for the inner tank and carbon steel, 9% nickel steel, or reinforced/prestressed concrete for the outer shell. The second type is a membrane tank wherein a thin (e.g. 1.2 mm thick) metallic membrane is installed within a cylindrical concrete structure which, in turn, is built either below or above grade on the ground. A layer of insulation is interposed between the stainless steel or Invar membrane and the load bearing concrete cylindrical walls and flat floor.

Recently, radical changes have been proposed in the construction of LNG terminals, especially import terminals. One such proposal involves the building of the terminal a short distance offshore where the LNG will be off-loaded from a transport vessel, stored, retrieved, and regasified before it is piped to shore for sale or use. Possibly one of the more promising of this type of terminals is one where the LNG storage tanks and regasification equipment will be installed on gravity base, box-shaped, barge-like structures (GBS) similar to certain concrete gravity structures now installed on the seafloor and being used as platforms for producing petroleum in the Gulf of Mexico.

Unfortunately, neither cylindrical tanks nor membrane tanks are considered as being particularly attractive for use in storing LNG on GBS terminals. Cylindrical tanks take up too much room on the GBS in relation to the volume of LNG which can be stored therein and are difficult and expensive to construct on such. Further the size of such tanks must be limited (e.g. 50,000 cubic meters) so that the GBS structures can be fabricated economically with readily available fabrication facilities. This necessitates a multiplicity of storage units to satisfy particular storage requirements which is not desirable from cost and operational safety considerations.

A membrane-type tank system, on the other hand, can be built inside the GBS to provide a relatively large storage volume. However, a membrane-type tank requires a sequential construction schedule wherein the outer concrete structure has to be completely built before the insulation and the membrane can be installed within a cavity within the outer structure. This normally requires a long construction period which adds substantially to the costs. Further, membrane-type tanks are designed by principles known as "experimental design" wherein the guarantee of satisfactory performance of a particular tank and its safety are based on historical experience and laboratory studies rather than on rigorous demonstration by analysis and quantified experience. Where new shapes and sizes are required or when different environmental and/or seismic loading conditions are to be encountered, the satisfactory performance of membrane-type tanks at various LNG levels is difficult to insure.

Accordingly, a tank system is needed for near offshore storage of LNG which alleviates the above-discussed disadvantages of both cylindrical tanks and membrane-type tanks. Such a tank is a polygonal-shaped, box-like, structure which can be fitted into a space within a steel or concrete GBS and which is capable of storing large volumes (e.g. 100,000 cubic meters and larger) of LNG at cryogenic temperatures. The tank should also perform safely at various LNG levels in areas where seismic activity (e.g. earthquakes) is encountered and where such activity may induce liquid sloshing and associated dynamic loads within the tank.

Similar box-shaped, polygonal tanks have been used for storing LNG aboard sea-going, transport vessels. One such tank, popularly known as the "Conch" tank, (e.g. see U.S Pat. No. 2,982,441) has been built from 9% nickel steel or aluminum alloys. In its original design as proposed by the above referenced patent, the tank is constructed of six plate panels (i.e. the four sides, the top or roof, and the bottom or floor of the tank) which are reinforced or "stiffened" only by horizontal beams and stiffeners or the like. According to the inventors, vertical stiffening is deliberately omitted in order to eliminate or reduce thermal stresses due to thermal gradients in the vertical direction as the volume of LNG in tank changes.

In the "Conch" tank, horizontal tie rods may be provided (a) at the corners at the vertical interfaces of the walls to strengthen the corners; and/or (b) as connections between the opposite faces of the walls to lessen the panels deflections. Nonetheless, horizontally-stiffened wall panels and two-way stiffened floor and roof plate panels, as embodied in the above referenced patent, basically provide the structural strength and stability for the tank. The original tanks built with this concept are reported to be less than 10,000 cubic meter in capacity.

When the Conch design (as illustrated in U.S. Pat. No. 2,982,441) is extended to larger tanks, a design similar to FIG. 1 can be expected (i.e. a known, prior-art, prismatic tank developed by IHI Co., Inc. of Tokyo, Japan). Modern materials and design methods do not restrict provision of vertical stiffening by consideration of thermal gradient as the liquid level of LNG changes. Consequently, the illustrated prismatic tank consists of wall plate panels that are stiffened by both horizontal and vertical beams/stiffeners. But even for a relatively small size of 23,500 cubic meters, to achieve satisfactory strength and stiffness during construction handling and operational use, the "Conch" tank must be provided with intermediate stiffened panel bulkheads and diaphragms, as illustrated by a vertical bulkhead in each of the length and width directions of the IHI tank. This type of design is believed to be good only for tanks having a relatively small storage capacity.

A larger tank suitable for use on a modern terminal and designed in accordance with the prior art would need still more bulkheads to support the roof structure and to provide structural strength and stability of the tank in operational use (e.g. see FIG. 2). Accordingly, a typical large storage tank might in effect be considered as consisting of several of the smaller Conch-type tanks aligned wherein a common wall between adjacent tanks forms a horizontal or transverse bulkhead within the overall storage volume of the complete storage system.

For applications on ships and other transport vessels, the bulkheads within the tanks not only provide strength and stability for a relatively large, storage tank but also reduce the dynamic loads on the tank due to any sloshing of the LNG within the tank caused by movement of the floating vessel during transport. The dynamic excitation of the storage tank due to the oscillatory motion of the ship caused by wind and wave action, has relatively large periods (e.g. 6–12 seconds). Fundamental periods of liquid sloshing within small cells created by bulkheads within the tank are relatively small thus avoiding resonance and amplification of sloshing loads. While the bulkhead construction makes such tanks suited for the marine transportation of LNG, it has certain drawbacks when applied to onshore or bottom-supported storage (e.g. GBS), primarily because in these environments, the dynamic excitation caused by seismic activity (e.g. earthquakes, etc.) is of much shorter periods (e.g. ½ to 1 second).

Due to the closeness of the fundamental periods of sloshing waves in small constrained spaces and the predominantly "short" excitation periods caused by seismic activity, the relative "short" dimensions of the individual compartments formed by the bulkheads in a storage tank become highly detrimental when sloshing in the tank occurs due to seismic activity. Accordingly, it is desirable for the storage space within a land-based LNG tank or a tank installed on a GBS which, in turn, is installed on the sea bottom, to be long and unimpeded since such open space helps to reduce the dynamic loads caused by the shorter excitation periods which will be encountered should any seismic, activity occur. Further, the large number of compartments, which are typically formed within the tank by the bulkheads, require multiple cryogenic pumping and handling systems for filling and emptying the tank and multiple penetrations and connections through the roof, which, in turn, lead to increased capital and operating costs as well as increasing the safety hazards normally involved with the storage and handling of LNG.

SUMMARY OF THE INVENTION

The present invention provides a large, box-like polygonal tank for storing liquefied gas which is especially adapted for use on land or in combination with bottom-supported offshore structure such as gravity-based structures (GBS) and a method of constructing the tank. "Box-like tank", as used herein, is intended to refer to a polygonal tank having two end walls, side walls, a top, and a bottom. Basically, the tank is comprised of (a) an internal, two-way truss frame structure, i.e., trusses in vertical planes, aligned in and crises-crossing along longitudinal (i.e., along the length) and transverse (i.e., along the width directions) and (b) a cover, sealingly enclosing the frame, for containing the stored liquid within the tank.

The internal, truss-frame is comprised of a plurality of vertical, elongated supports and horizontal, elongated supports, connected at their respective ends to form a box-like frame which, in turn, has tubular and non-tubular beams, column and brace members secured therein to provide additional strength and stability along the length and width directions of the truss frame. A plurality of stiffened or unstiffened plates (e.g. 9% nickel-steel, aluminum, aluminum alloys, etc.) are secured to the outside of box-like frame to form the cover for the tank.

Many different arrangements of the beams, columns and braces can be devised to achieve the desired strength and stiffness of a truss frame as illustrated by the use of trusses on bridges and other civil structures. For the tank of the present invention, the truss frame construction in the longitudinal and transverse directions may not be identical, or even similar. Rather, the trusses in the two directions are designed to provide the specific strength and stiffness required for the over all dynamic loads caused by seismic activity, the need to support the large roof structure and the loads due to the unavoidable unevenness of the floor. In the preferred embodiment of this invention, suitable for areas of moderate seismic activity, the internal truss structure may be provided only in the transverse direction with no truss(es) in the longitudinal direction.

More specifically, the large, box-like polygonal storage tank of the preferred embodiment of the present invention is comprised of two substantially identical end sections and none, one, or a plurality of intermediate sections. All of the intermediate sections have basically the same construction and each is comprised of a rigid frame which, in turn, is formed of at least two vertical, elongated supports and at least two horizontal, elongated supports, connected at their respective ends. Additional supports, beams, columns and brace members are secured within said frame to provide additional strength and stability to the frame. A plurality of plates are secured to the outside of said frame which form the cover or containment walls of said tank when the respective sections are assembled.

By using a box-like internal truss frame to provide the primary support for the tank, the interior of the tank will be effectively contiguous throughout without any encumbrances provided by any bulkheads or the like. This permits the relatively long interior of the present tank to avoid resonance conditions during sloshing under the substantially different dynamic loading caused by seismic activity as opposed to the loading which occurs due to the motion of a sea-going vessel.

BRIEF DESCRIPTION OF THE DRAWINGS

The actual construction operation, and apparent advantages of the present invention will be better understood by referring to the drawings, not necessarily to scale, in which like numerals identify like parts and in which.

BEST KNOWN MODE FOR CARRYING OUT THE INVENTION

Figure 1:
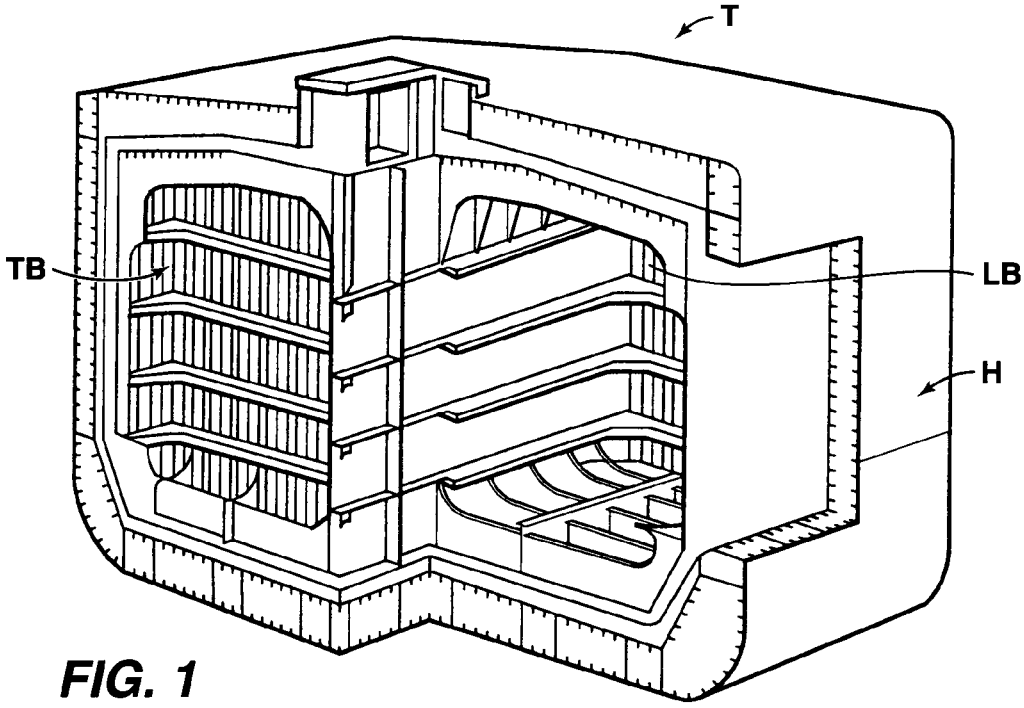
FIG. 1 (PRIOR ART)
FIG. 1 is a simplified, perspective view, partly in section, illustrating a typical LNG storage tank currently in use and designed in accordance with the prior art.
Figure 2:
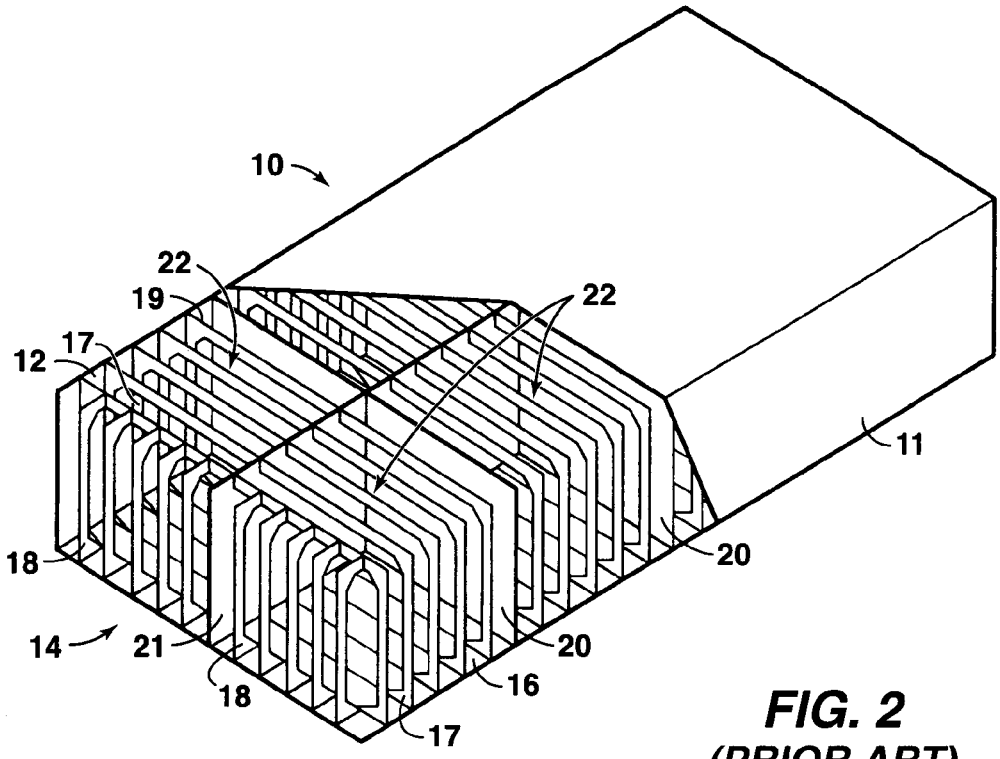
FIG. 2 (PRIOR ART)
FIG. 2 is the perspective view of a large storage tank suitable for use on a modern terminal and which is designed in accordance with an extension of the prior art.
Figure 3:
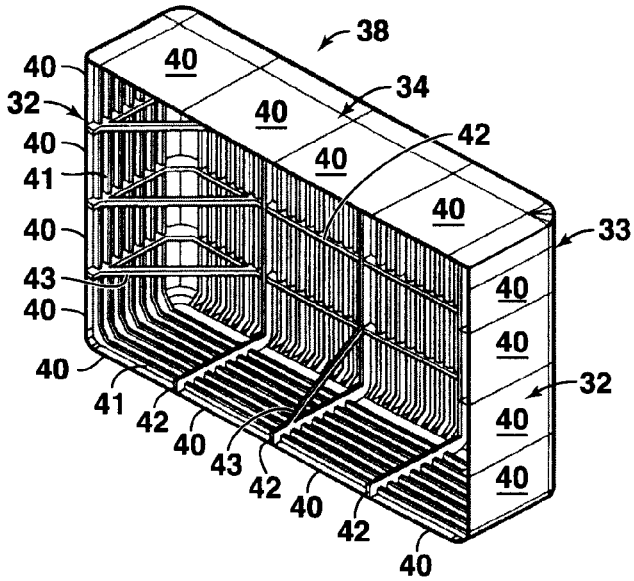
FIG. 3 is a perspective view of an end section of an LNG storage tank in accordance with the preferred embodiment of the present invention.
Figure 4:
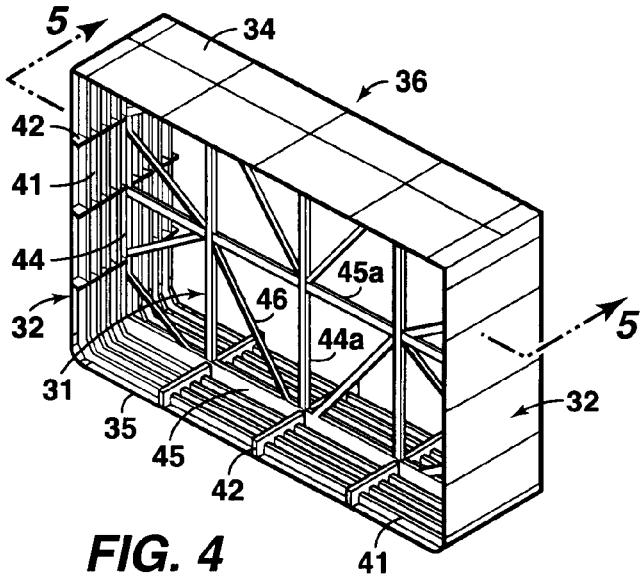
FIG. 4 is a perspective view of an intermediate section of the preferred embodiment of the present invention.

Referring more particularly to the drawings, FIG. 1 illustrates a typical, state-of-the-art, polygonal, box-shaped tank "T" of a type now being used for storing LNG within the hull "H" of a marine vessel during transport. The 23,500 cubic meter tank is subdivided into four cells by a pair of bulkheads, one longitudinal bulkhead "LB" and one transverse bulkhead "TB". Such a tank is one which was designed by IHI Co., Inc., Tokyo, Japan. FIG. 2 illustrates a large tank 10 (five times the size of the state-of-the-art polygonal tank of FIG. 1) which might be built using the same basic principles of the prior-art, tank design.

Basically, tank 10 is comprised side plates 11, 12, end plates 13, 14 (plate 14 is removed for clarity), top or roof plate 15, and bottom or floor plate 16. A plurality of longitudinally-spaced, vertical plates form transverse vertical bulkheads, 20, while longitudinal-extending, vertical plate(s) forms longitudinal bulkhead 21 (only one shown in this design). These bulkheads provide the necessary strength and stiffness for the tank when storing LNG during marine transport.

Side plates 11, 12 are reinforced or "stiffened" by a plurality of horizontally-spaced, vertical members 17, 18 (only some numbered for clarity), respectively (e.g. steel or aluminum T-stiffeners, blade stiffeners, etc.). End plates 13, 14 are stiffened by similar members 18 while roof plate 15 is stiffened by members 19. Positioned in between the respective stiffening members 17, 18 or 19, may be a plurality of additional members (not shown) to stiffen the respective plates in the orthogonal direction, e.g., between vertical members 18, a plate may be stiffened by a plurality of vertically-spaced horizontal members, etc.

The bulkheads, 20 and 21, which span the full depth from roof to floor of the tank, are likewise stiffened by horizontally-spaced, vertical stiffeners and vertically-spaced, horizontal stiffeners (not shown for clarity). As will be understood in the art, a typical construction of tank 10 might involve welding or otherwise securing the support members and/or stiffeners to their respective section of plating before the sections are assembled together to form box-like tank 10.

Tanks having much larger LNG storage capacities (e.g. 100,000 cubic meters or greater) are more desirable for land-based or GBS applications. In the prior-art designed tanks such as those discussed above, the use of bulkheads is considered necessary to achieve the strength and stiffness necessary for such large tanks, especially when used in marine transport operations. That is, the full depth bulkheads (e.g. 20, 21 in FIG. 2) of the prior art also provide the added benefit of subdividing the tank into individual compartments 22. Although these cells 22 may require individual filling and/or emptying lines, pumps, etc. which normally add significantly to capital and operating costs, they do provide the benefit of reducing dynamic loads which result from the "sloshing" of the LNG within the tank which, in such, is due to the motion of the vessel.

The dynamic loads is reduced because the fundamental periods of the waves of the liquid sloshing within the small confined spaces of the individual cells 22 do not closely correspond to the excitation periods caused by the motion of the vessel. On the other hand, in land-based or GBS storage tanks, any such dynamic loads imposed within a storage tank will be likely be caused by seismic activity which has much shorter excitation periods (from about ½ to about 1 second). Where bulkheads of the prior art are used in such environments, the dynamic loads may become amplified when the natural periods of the sloshing within the cells created by bulkheads are of similar duration. Accordingly, spaced bulkheads are considered to be detrimental in the large-capacity, LNG storage tanks when the tanks are to be land-based or GBS supported.

Referring now to FIGS. 3–7, a liquefied natural gas (e.g. LNG) storage tank 30 of the present invention is illustrated. Basically, tank 30 is comprised of an internal, truss-braced frame system 31 which is covered with plating or panels (i.e. cover) which provides the containment for the liquid to be stored within the tank. The panels, which form the sides 32, ends 33, roof 34, and bottom 35 of the tank 30, may be either unstiffened or stiffened. The respective panels, when assembled (1) provide the physical barrier which contains the LNG within the tank and (2) bear the local loads and pressures which, in turn, are transmitted to stiff frame system 31. Frame system 31 is ultimately responsible for any global/overall loads, including seismic loads caused by earthquakes, etc.

More specifically, storage tank 30 is a freestanding, box-shaped, polygonal tank which is capable of storing large amounts (e.g. 100,000 cubic meters or more) of liquefied natural gas (LNG). While different construction techniques may be used, FIGS. 3–7 illustrate a preferred method of assembling tank 30. Basically, tank 30 is comprised of two end sections 38 (FIG. 3) and a plurality of intermediate sections 36 (FIGS. 5 and 6) positioned therebetween. Each end section 38 has basically the same construction and is formed from panels 40 which are connected together (e.g. welded or the like) to form end plate 33. These panels are also used to form a segment of roof plate 34, side plates 32 and bottom plate 35 when the tank is assembled.

Panels 40 can be made from any suitable material which is ductile and which has acceptable fracture characteristics at cryogenic temperatures (e.g. 9% nickel steel, aluminum, aluminum alloys, etc.). As shown, end plate 33 and the segments of roof plate 34, side plates 32, and bottom plate 35 are reinforced with both members 41 and cross members 42 (e.g. T-stiffeners, blade stiffeners or the like, only some numbered for clarity). Angled braces 43 may also be provided across the corners and/or edges of abutting plates to give additional strength and rigidity to the end sections 35.

Figure 5:
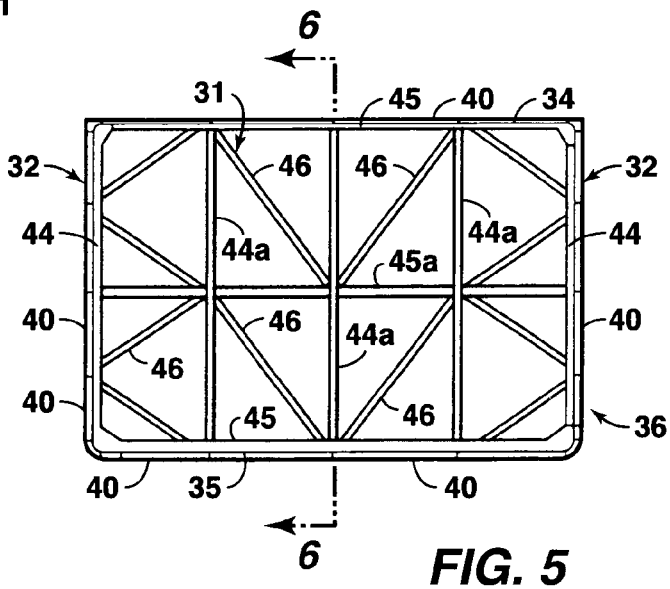
FIG. 5 is a view as would be seen from line 5—5 of FIG. 4.
Figure 6:
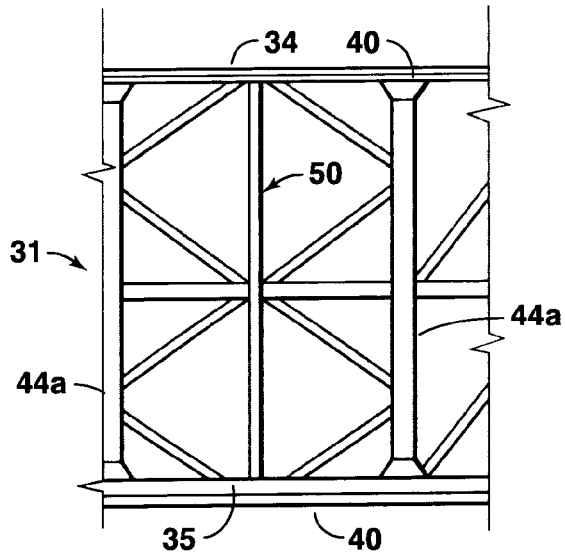
FIG. 6 is a view as would be seen from line 6—6 of FIG. 5.
Figure 7:
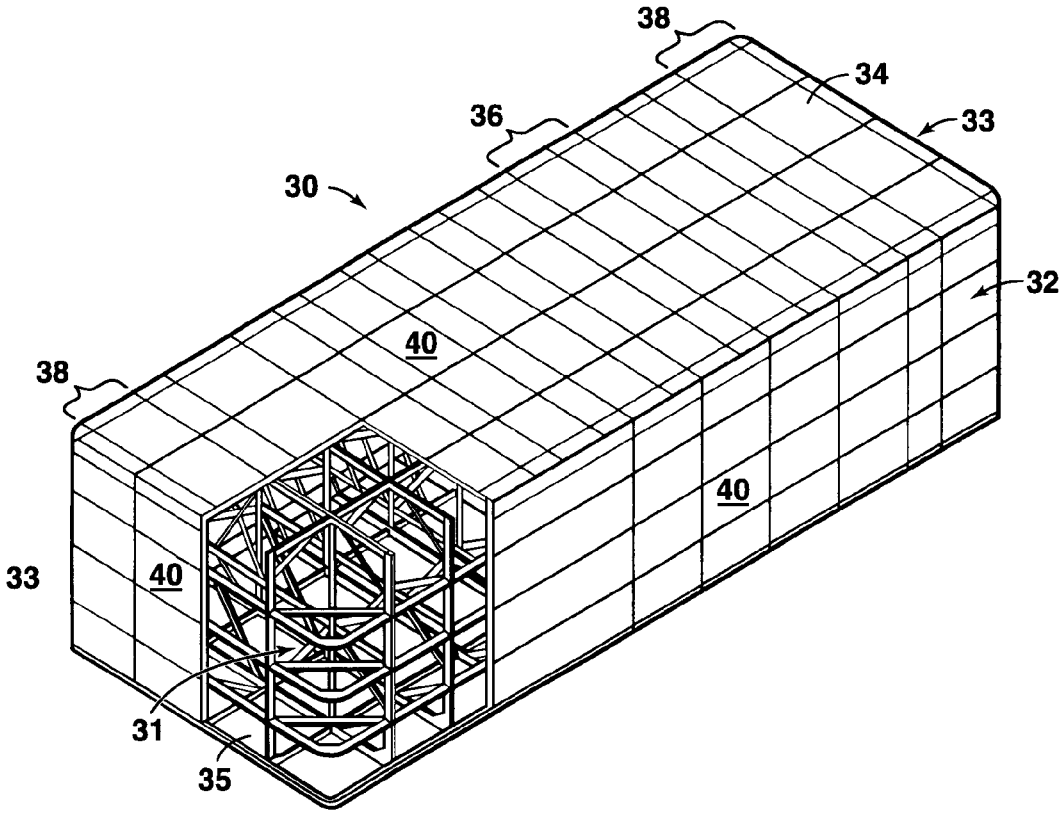
FIG. 7 perspective view, partly in section, illustrating an assembled, storage tank in accordance with the preferred embodiment of the present invention.

Intermediate section(s) 36 is preferably formed by first building a segment of the internal, truss frame 31 and then affixing panels 40 to the outside thereof. To do this, a segment of truss frame 31 may be formed by connecting the ends of two vertical members 44 to the ends of two horizontal members 45 (e.g. I-beams, H-beams, square or round tubulars or the like) to form a rigid, box-like structure (see FIG. 5). Additional vertical members 44*a* and horizontal member(s) 45*a* is typically secured within the outer, box-like structure to give it additional strength. Angled truss members 46 are added to complete the segment of truss frame 31. Many different arrangements of beams, columns and brace members comprising the frame in FIG. 5 can be used which would, when assembled, provide the desired strength and stiffness for the internal truss frame 31 of the tank. FIG. 5 illustrates only one such arrangement.

Several or the smaller panels 40 can first be assembled together and can be reinforced with supports 41, 42 before the assembled panels are secured (e.g. welded or the like)

onto the outside of its respective segment of frame 31. Once the end sections 35 and all of the intermediate sections 36 are completed, they are assembled and welded or otherwise secured together to form tank 30 (FIG. 5). If additional brace members (e.g. longitudinal trusses 50 positioned and secured between vertical members 44*a*, see FIG. 6) are required to strengthen the truss in the longitudinal direction, they can be installed after assembly of the tank or prior to it when building end sections 35 or intermediate sections 36.

It can be seen that due to the openness of internal, truss frame 31, the interior of tank 30 is effectively contiguous throughout so that LNG or other liquid stored therein is free to flow from end-to-end without any effective encumbrances in-between. This inherently provides a tank having more efficient storage space than is present in the same-sized tank having bulkheads and one which requires a single set of tank penetrations and pumps to fill and empty the tank. More importantly, due to the relatively long, open spans of tank 30 of the present invention, any sloshing of the stored liquid, caused by seismic activity, induces relatively small dynamic loading on the tank. This loading is significantly smaller than it would otherwise be if the tank had multiple cells created by the bulkheads of the prior art.

What is claimed is:

1. A large, polygonal tank having side walls, end walls, a top, and a bottom for storing liquids, said tank comprising:

an internal, polygonal-shaped truss-braced frame structure, said internal frame structure comprising:

a plurality of aligned vertical truss structures extending transversely and longitudinally-spaced from each other along the length of said internal frame structure; each of said plurality of vertical truss structures comprising:

a plurality of both vertical, elongated supports and horizontal, elongated supports, connected to form a closed outer periphery of each said vertical truss structure, and additional support members secured within and between said connected vertical and horizontal, elongated supports to thereby form each said vertical truss structure; and a cover sealing attached to each of said connected vertical and horizontal, elongated supports which form said outer periphery of each of said vertical truss structures for containing said liquids within said tank.

2. The tank of claim 1 wherein at least one said vertical truss structures is positioned longitudinally within said internal frame structure and is secured between two adjacent said longitudinally-spaced vertical trusses.

3. The tank of claim 1 wherein said cover comprises:

a plurality of plates stiffened by a plurality of stiffening members in the vertical and/or horizontal directions secured to the outside of said internal truss structure.

4. The tank of claim 3 wherein said plates are comprised of 9% nickel steel.

5. The tank of claim 3 wherein said plates are comprised of aluminum.

6. The tank of claim 2 wherein said plates are comprised of 9% nickel steel.

7. The tank of claim 2 wherein said plates are comprised of aluminum.

8. A large, polygonal tank for storing liquids having side walls, two end walls, a top, and a bottom, said tank comprising two end sections; each end section comprising:

one of said two end walls; said one end wall having two sides, a top, and a bottom;

a plurality of plates secured to each of said two sides of said one end wall to form respective segments of each of said side walls of said tank;

a plurality of plates secured to said bottom of said one end wall to form a segment of said bottom of said tank; and a plurality of plates secured to said top of said one end wall to form a segment of said top of said tank;

at least one intermediate section positioned and secured between said two end sections, said intermediate section comprising:

a plurality of both vertical, elongated supports and horizontal, elongated supports, connected to form a closed outer periphery of a vertical truss structure, additional support members secured within and between said outer periphery of said connected vertical and horizontal, elongated supports to thereby form said vertical truss structure; and a plurality of plates secured to said outer periphery of said vertical truss structure to thereby form an intermediate segment of each of said side walls, said bottom, and said top of said tank;

wherein said plurality of plates secured to said vertical truss structure are secured to the respective plates on each of said end sections to form said side walls, said bottom, and said top of said tank.

9. The tank of claim 8 including:

at least one additional intermediate section having a truss structure;

at least one longitudinally-positioned vertical truss secured between said vertical truss of said at least one intermediate section and said vertical truss of said at least one additional intermediate section.

10. A method of constructing a large, polygonal tank having two end walls, side walls, a top, and a bottom for storing liquids, said method comprising:

building two end sections wherein each of said end sections is constructed by:

forming one of said two end walls wherein said one end wall has sides, a top, and a bottom;

attaching a plurality of plates to said sides of said one end wall to form respective segments of each of said side walls of said tank;

attaching a plurality of plates to said top of said one end wall to form a segment of said top of said tank;

attaching a plurality of plates to said bottom of said one end wall to form a segment of said bottom of said tank; and building at least one intermediate section wherein said at least one intermediate section is constructed by:

forming a vertical truss structure by connecting a plurality of both vertical, elongated supports and horizontal, elongated supports together to form a closed outer periphery of said vertical truss structure and securing additional support members within said outer periphery between said respective vertical and horizontal supports to form said vertical truss structure; and securing plates to both said vertical and horizontal supports which form said outer periphery of said vertical truss structure to thereby form said intermediate section; and securing said at least one intermediate section between said two end sections by joining said plurality of plates on said intermediate section to the respective said plurality of plates on said two end sections to thereby form said polygonal tank with said joined plates forming the containment walls of said tank when said two end sections and said at least one intermediate sections are secured together.

* * * * *